US006573876B1

(12) United States Patent
Maroko et al.

(10) Patent No.: US 6,573,876 B1
(45) Date of Patent: Jun. 3, 2003

(54) PRINTED CIRCUIT BOARD ANTENNA

(75) Inventors: Moshe Maroko, Hod Hasharon (IL); Shoshan Hendler, Holon (IL); Emil Sasson, Kibbutz Ein-Shemer (IL)

(73) Assignee: Eureka U.S.A. Ltd., Tel-Aviv (IL)

( * ) Notice: Subject to any disclaimer, the term of this patent is extended or adjusted under 35 U.S.C. 154(b) by 0 days.

(21) Appl. No.: 09/708,004

(22) Filed: Nov. 8, 2000

(30) Foreign Application Priority Data

Nov. 14, 1999 (IL) ..... 132927

(51) Int. Cl.[7] ..... H01Q 1/50

(52) U.S. Cl. ..... 343/906; 343/725; 343/770; 343/907

(58) Field of Search ..... 343/725, 748, 343/751, 767, 770, 893, 906, 907; 439/578, 579

(56) References Cited

U.S. PATENT DOCUMENTS 3,879,103 A * 4/1975 Peltola et al. ..... 339/177 R
5,098,314 A * 3/1992 Castagna et al. ..... 439/578
5,402,136 A 3/1995 Goto et al.
5,519,406 A 5/1996 Tsukamoto et al.
5,940,966 A * 8/1999 Fasano et al. ..... 29/842

FOREIGN PATENT DOCUMENTS

DE 2453917 A * 5/1976 ..... E04B/1/58
JP 09-055609 2/1997
JP 09055609 A * 2/1997 ..... H01Q/1/00

OTHER PUBLICATIONS

Kuga et al., "Notoh Wire Composite Antenna For Polarization diversity Reception", IEEE, vol. 46, No. 6, Jun. 1998, pp. 902–905.

* cited by examiner

*Primary Examiner*—Don Wong
*Assistant Examiner*—Shih-Chao Chen
(74) *Attorney, Agent, or Firm*—AlphaPatent Associates Ltd.; Daniel J. Swirsky

(57) ABSTRACT

A printed circuit board antenna is a diversity polarization antenna for connecting with a printed circuit board. The antenna includes a fixed height connector, a horizontally polarized antenna, and a vertically polarized antenna. The phase center of the vertically polarized antenna coincides with the phase center of the horizontally polarized antenna.

11 Claims, 7 Drawing Sheets

PRINTED CIRCUIT BOARD ANTENNA

FIELD OF THE INVENTION

The present invention relates to diversity antennas generally and to polarization diversity antennas in particular.

BACKGROUND OF THE INVENTION

Diversity antennas are used to exploit the random nature of radio wave propagation by finding significantly uncorrelated signal paths for wireless communication. They are of particular use in mobile wireless communication which requires that the signal be transmitted with high quality. Space and pattern diversity are very popular in land-mobile communication but require large mounting space to obtain high diversity efficiency.

Indoor wireless networks require less space for antennas. One example is a notch-wire antenna described in the article "A Notch-Wire Composite Antenna for Polarization Diversity Reception" by Kuga et al., *IEEE Transactions on Antennas and Proragation,* Vol. 46, No. 6, June 1998, pp. 902–905, and in U.S. Pat. No. 5,402,136, both of which are incorporated herein by reference. This antenna provides polarization diversity reception in an indoor wireless system. The antenna is formed of two antennas, a disk antenna having three notches therein and a wire-loop antenna.

Other notch antennas are described in U.S. Pat. No. 5,591,401.

Unfortunately, these antennas require coaxial cables to connect them to the system that processes the received signal. Usually, the system is implemented in a printed circuit board to which it is not easy to connect a coaxial cable. To do so requires a special adapter that provides a smooth transition of the characteristic impedance, from the impedance of the coaxial line to the impedance of the electronics of the printed circuit board. Furthermore, connecting a coaxial cable to the elements of the antenna requires welding or soldering. Both are costly and time-consuming processes.

Moreover, the printed circuit board forms a ground plane that interferes with the horizontally polarized antenna of the polarization pair. Once connected to the printed circuit board, the radiation pattern performance of the horizontally polarized antenna deteriorates. This degrades the advantage of the polarization diversity.

SUMMARY OF THE INVENTION

An object of the present invention is to provide an antenna that is connected to a printed circuit board via a coaxial connector.

A further object of the present invention is to provide a coaxial connector that is relatively easy to manufacture.

There is therefore provided, in accordance with a preferred embodiment of the present invention, a diversity polarization antenna for connecting to a printed circuit board. The antenna includes a horizontally polarized antenna, a vertically polarized antenna whose phase center coincides with the phase center of the horizontally polarized antenna and a fixed height coaxial connector. The connector connects the antennas to the printed circuit board and has a height such that the deviation of the radiation pattern of the horizontally polarized antenna from omnidirectionality is within ±6 dB.

Additionally, in accordance with a preferred embodiment of the present invention, the connector includes two metal tubes of the fixed height, two insulating tubes locatable in one of the two metal tubes and an eyelet connector. The insulating tubes have a diameter which is slightly wider than the outer diameter of a metal wire. The eyelet connector has two short toothed tubes which receive the metal tubes and have a diameter which is generally the same as the outer diameter of the metal tubes. The eyelet connector also has at least two pins for connecting into the printed circuit board.

Moreover, in accordance with a preferred embodiment of the present invention, the two metal tubes are formed into a double tube unit Alternatively, in accordance with a preferred embodiment of the present invention, the antenna includes a radiating wire for a vertically polarized antenna, a feeding wire for a horizontally polarized antenna metal disk with notches and a fixed height coaxial connector. The metal disk forms part of the vertically polarized antenna and the notches form part of the horizontally polarized antenna. The connector physically and electrically connects the wires and the metal disk to the printed circuit board.

Further, in accordance with a preferred embodiment of the present invention, the metal disk has two short, toothed tubes, the center of one of which coincides with the center of the metal disk.

Still further, in accordance with a preferred embodiment of the present invention, the connector includes two metal tubes locatable within the toothed tubes of the metal disk, two insulating tubes, which receive and insulate the feeding and radiating wires and an eyelet connector. Each insulating tube is locatable in one of the two metal tubes. The eyelet connector has two short toothed tubes that receive the metal tubes and at least two pins, which connect into the printed circuit board. The toothed tubes have a diameter, which is generally the same as the outer diameter of the metal tubes.

Moreover, in accordance with a preferred embodiment of the present invention, the antenna also includes a support disk to which the metal disk and the wires are attachable.

Further, in accordance with a preferred embodiment of the present invention, the radiating wire has arms, the metal disk is attachable to an undersurface of the support disk and the support disk has supports for the arms which hold the arnms at a distance L above an upper surface of the support disk.

There is also provided, in accordance with a preferred embodiment of the present invention, an antenna which connects to a printed circuit board and which includes a horizontally polarized antenna and a fixed height coaxial connector such as is described hereinabove.

Moreover, in accordance with a preferred embodiment of the present invention, the coaxial connector can have one or two sections for connecting one or two antennas.

The present invention incorporates the antenna, the coaxial connector and the eyelet connector individually and in combination.

There is also provided, in accordance with a preferred embodiment of the present invention, a method of manufacturing a double tube outer connector of a coaxial connector. The method includes the steps of providing a rectangular metal sheet having two long and two short edges with cutouts at the center of its long edges and rolling each of the two short edges toward the center, thereby to form two double tubes.

Finally, there is further provided, in accordance with a preferred embodiment of the present invention, a method of connecting at least a horizontally polarized antenna to a printed circuit board. The method includes the steps of connecting the antenna to a fixed height coaxial connector, the height of the connector being such that that the deviation of the radiation pattern of the horizontally polarized antenna from omnidirectionality is within ±6 dB and connecting the connector to the printed circuit board.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

The present invention is an antenna and a coaxial connector for use in an indoor wireless system, which can be relatively easily connected to a printed circuit board.

Figure 1:
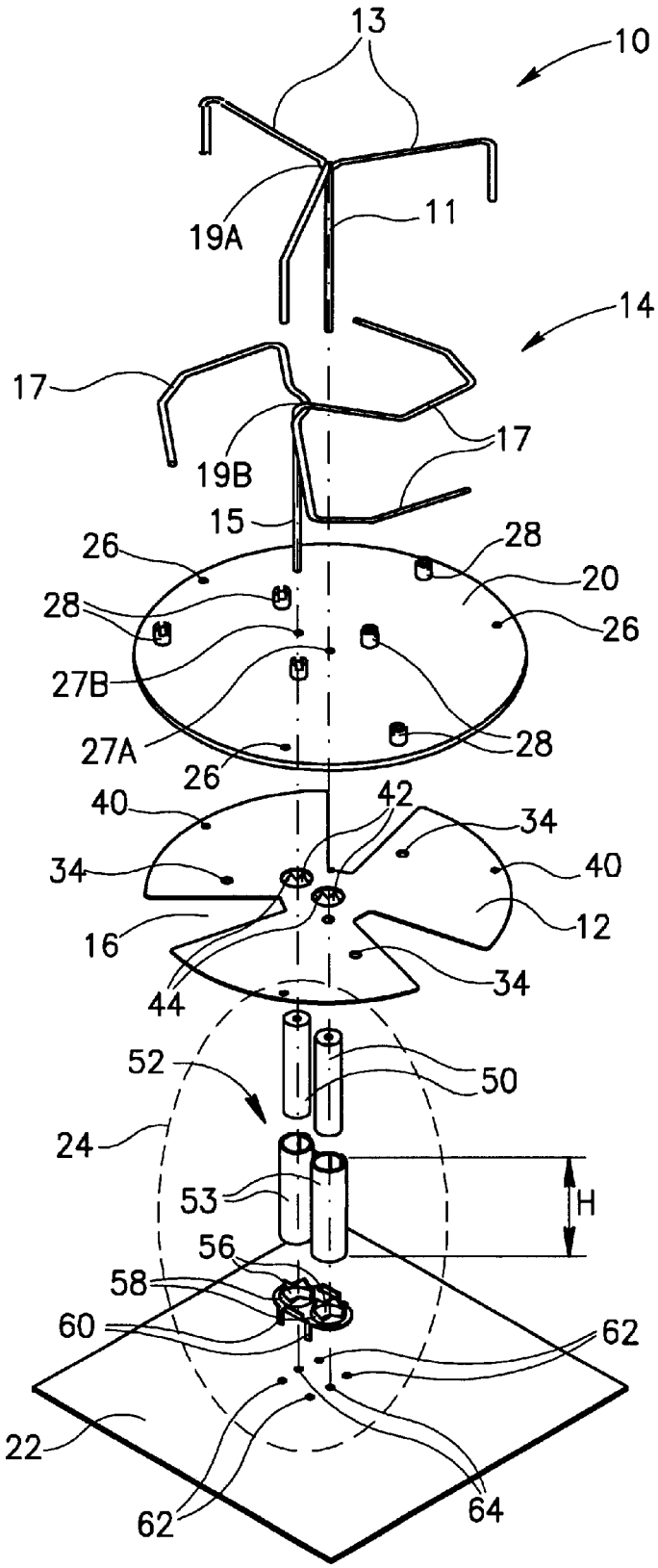
FIG. 1 in a schematic, exploded view of an antenna and coaxial connector, constructed and operative in accordance with a preferred embodiment of the present invention.

Reference is now made to FIG. 1, which is an exploded view of the antenna and connector of the present invention. The antenna is a notch-wire composite antenna formed of a vertically polarized antenna and a horizontally polarized antenna.

The vertically polarized antenna comprises a radiating wire 10 and a metal disk 12. The horizontally polarized antenna comprises a feeding wire 14 and notches 16 of metal disk 12. Radiating wire 10 has a central leg 11 and three outer legs 13, typically about 120° apart. Feeding wire 14 has a central leg, labeled 15, and three curved arms, labeled 17. Radiating wire 10 is formed from two wires, point welded together at point 19A. Feeding wire 14 is formed from two wires, point welded together at point 19B. Metal disk 12 is connected to a printed circuit board 22 via a coaxial connector 24.

Both sets of wires are formed from copper coated, iron wires. The copper provides for good electrical contact and the iron provides rigidity to withstand environmental conditions. In addition, since the wires are formed of iron, they can be point welded rather than soldered.

The antenna components are held in place with a support disk 20. Support disk 20 is typically formed of a plastic with a low dissipation factor to enable the electromagnetic wave propagation to occur with little or no loss of signal.

Support 920 has holes 26 through which outer legs 13 extend and holes 27A and 27B through which central legs 11 and 15, respectively, extend. Support disk 20 also has supports 28, which hold arms 17 at a fixed distance L above the plane of support disk 20. Fixed distance L is typically a few millimeters, such as 1–5 mm.

Figure 2A:
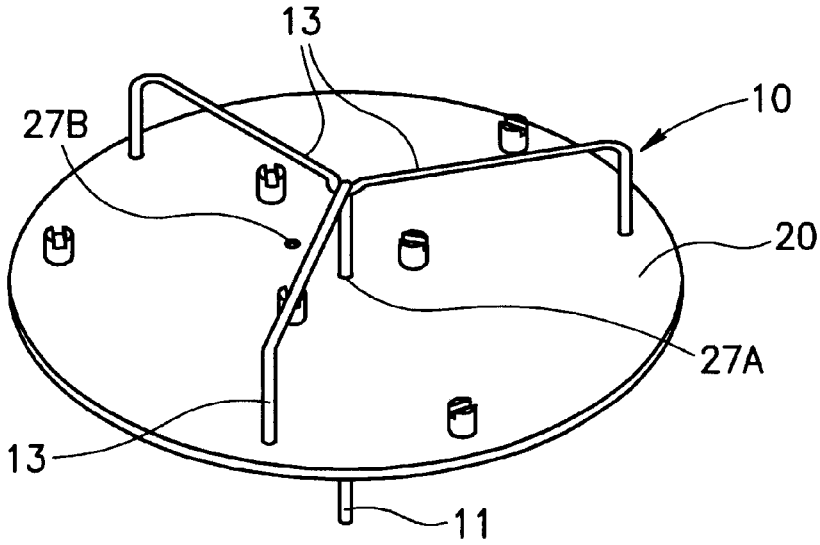
FIGS. 2A and 2B are isometric illustrations of radiating and feeding wires of the antenna of FIG. 1 connected to a support disk of the antenna.
Figure 2B:
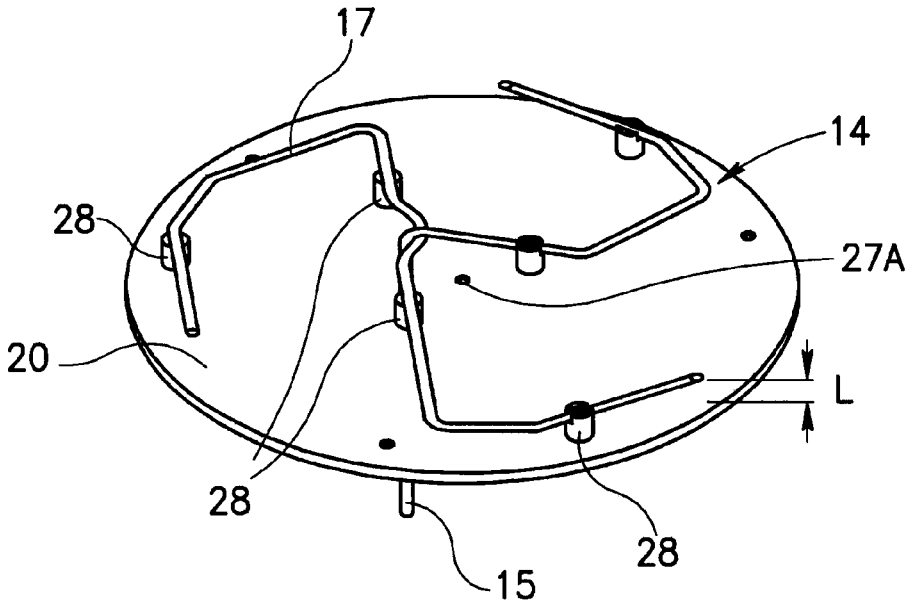

Reference is now briefly made to FIGS. 2A and 2B, which respectively illustrate radiating wire 10 and feeding wire 14 connected to support disk 20. As can be seen in FIG. 2A, central leg 11 extends through hole 27A, which is located at the center of support disk 20. Outer legs 13 of feeding wire 10 are approximately of equal length, which ensures that the phase center of the vertically polarized antenna falls at the center of support disk 20. Since hole 27A also falls at the center of metal disk 12, the phase center of the vertically polarized antenna falls on the center of the support disk 20 and on center of the metal disk 12.

FIG. 2B shows the assembly of feeding wire 14 and support disk 20. It can be seen that supports 28 hold feeding wire 14 at the fixed distance L above support disk 20. Arms 17 of feeding wire 14 act as transmission lines, where metal disk 12 (FIG. 1) serves as an electrical ground plane and arms 17 are the conductors. The combination of the thickness of support disk 20 and the thickness L of the air layer between the upper surface of support disk 20 and arms 17 provide control of the characteristic impedance of the transmission lines. In this way, the antenna impedance can be matched to operate in the presence of printed circuit board 22 (FIG. 1).

Since notches 16 area located at an equal distance from the center of the support disk 20 (and of metal disk 12), and arms 17 of feeding wire 14 are approximately of equal length, the phase center of the horizontally polarized antenna also falls at the center of support disk 20. Therefore, the phase center of the horizontally polarized antenna is collocated with the phase center of the vertically polarized antenna.

Figure 3:
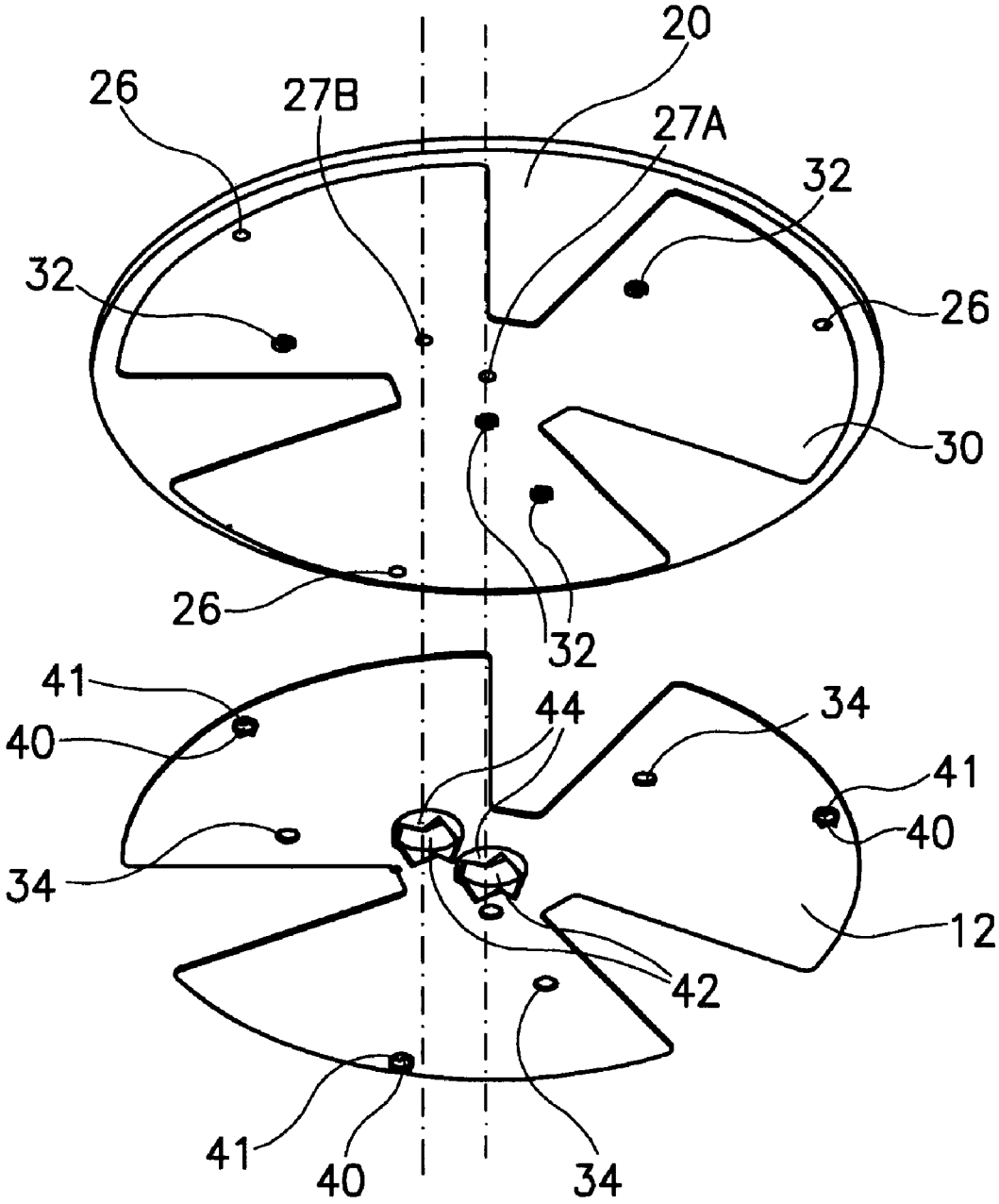
FIG. 3 is an exploded view, from the bottom, of the support and metal disks.

FIG. 3 shows a portion of the antenna of FIG. 1 viewed from the bottom. As can be seen, support disk 20 has an indentation 30 on its underside having the general shape of notched metal disk 12. Support disk 20 also includes round snaps 32 designed to help hold metal disk 12 to support disk 20 as an undersurface. When antenna is assembled, snaps 32 extend through holes 34 of metal disk 12.

Metal disk 12 includes small punched holes 40, which align with holes 26 of support disk 20, and receive outer legs 13. Metal disk 12 also includes punched holes 42, which align with holes 27 of support disk 20. Due to the punching, holes 40 and 42 are surrounded on the underside, by respectvely, teeth 41 and 44. Teeth 41 ensure that outer legs 13 are electrically connected to metal disk 12.

Returning to FIG. 1, connector 24 comprises two insulator tubes 50, an external, metal double tube 52 (formed of two tubes 53) and an eyelet connector 54 having two punched holes 56 surrounded by teeth 58. In addition, eyelet connector 54 comprises a plurality of pins 60 capable of being placed into holes 62 of printed circuit board 22. As can be seen, teeth 58 face away from printed circuit board 22 while pins 60 face towards board 22.

It is noted that printed circuit board 22 also has holes 64, which receive central legs 11 and 15, as described hereinbelow.

Figure 4A:
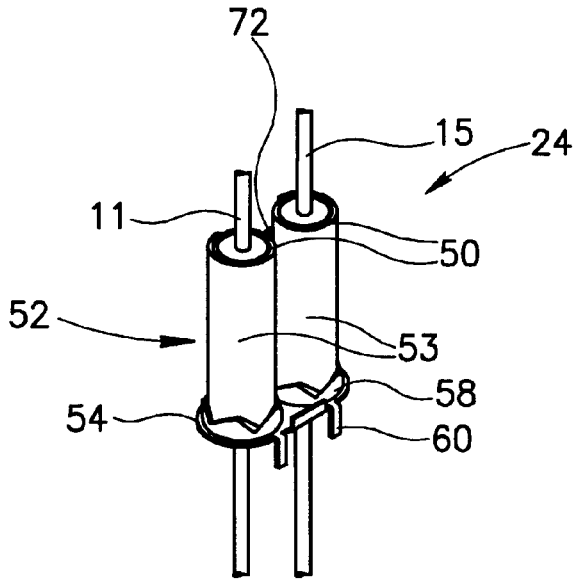
FIG. 4A is a schematic illustration of the connector of the present invention in its assembled form.
Figure 4B:
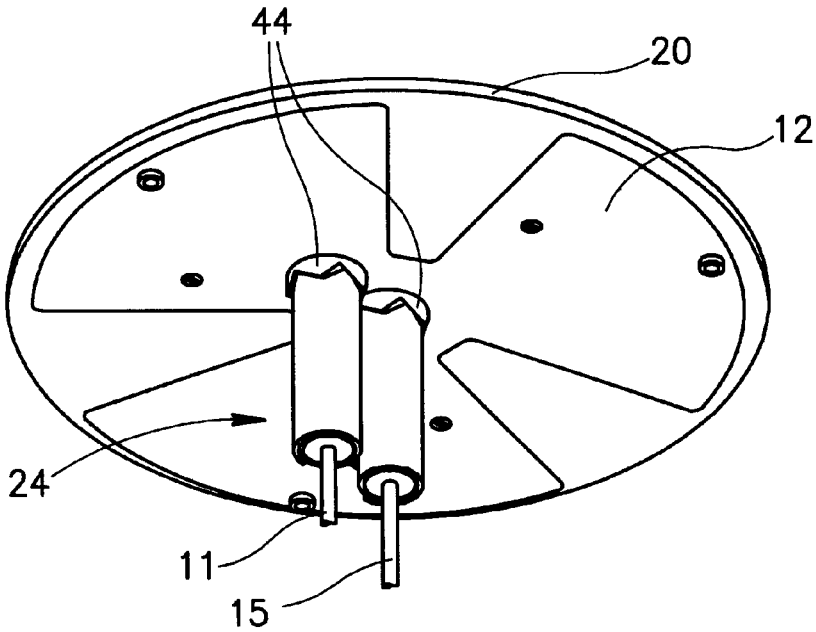
FIG. 4B is a schematic illustration of the connector of FIG. 4A connected to the disk.
Figure 5A:
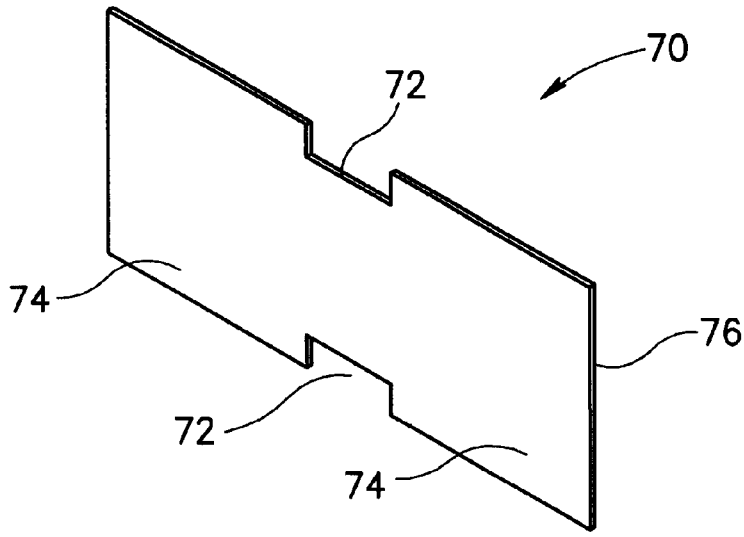
FIGS. 5A and 5B are schematic illustrations of an unrolled sheet and its process of assembly, respectively.

References now made to FIGS. 4A and 4B, which substrate connector 24, freestanding and connected to metal disk 12, respectively.

insulator tubes 50 are designed to insulate central legs 11 and 15 from outer tubes 53. When assembled, insulator tubes 50 are inserted into tubes 53 of double tube 52 and the unit is connected to eyelet connector 54. Double tube 52 includes a cutout 72 (shown best in FIG. 5A) which ensures that double tube 52 can be placed into eyelet connector 54 without interference from teeth 58 of eyelet connector 54. Furthermore, teeth 58 are bent outwards to ensure that they do not interfere during insertion of double tube 52.

Because the diameter of punched holes 56 is approximately the same as the diameter of each of tubes 53 of double tube 52, teeth 58 provide good mechanical and electrical contact between double tube 52 and eyelet connector 54. This can be seen in FIG. 4A, which also shows central legs 11 and 15 within connector 24.

Central legs 11 and 15 serve as inner conductors and tubes 53 serve as outer conductors of a coaxial structure. The dielectric properties of insulator tubes 50 are such that the coaxial structure has a predetermined characteristic impedance that preserves continuity of electric impedance between the antenna and the printed circuit board 22.

The combined unit is then connected to metal disk 12 by placing it within teeth 44 of holes 42. Similar to teeth 58, teeth 44 provide good mechanical and electrical contact between double tube 52 and metal disk 12 and are bent outwards.

This is shown in FIG. 4A, which also shows central legs 11 and 15 within connector 24. A second cutout 72 (shown best in FIG. 5A) is present to ensure that double tube 52 can be placed into holes 42 without interference from teeth 44.

It will be appreciated that connector 24 provides two coaxial connections between the antenna of the present invention and metal lines (not shown) on the underside of printed circuit board 22. Metal disk 12 is connected to the metal lines through teeth 44, which are connected to metal tubes 53, which are connected to teeth 58 of eyelet connector 54 which has pins 60 which extend through holes 62 of printed circuit board 22. Central legs 11 and 15 of radiation wire 10 and feeding wire 14, respectively, are directly connected to the metal lines of printed circuit board 22. That is, central legs 11 and 15 extend through holes 27 of support disk 20, through insulator tubes 50 and through holes 64 (FIG. 1) of printed circuit board 22.

It will further be appreciated that most of the antenna of the present invention is assembled through mechanical pressure, rather than welding or soldering. This includes the electrical contact among the various metal elements. Mechanical robustness is achieved through the elasticity of the materials and the friction between the parts.

Printed circuit board 22 acts as a known ground plane for the antenna. Usually, when a horizontally polarized antenna is placed on top of a metal ground plane 22, currents are induced in ground plane 22 that creates an image antenna having an opposite direction to the original, horizontally polarized antenna. Because the horizontal electric field component that is formed in the ground plane has a phase reversal, it tends to attenuate the radiated energy emanating from the original antenna. Coaxial connector 24 sets the polarized antenna at a height H (FIG. 1) which is large enough that this phenomenon is kept to an acceptable level. A common accepted level is a deviation from omnidirectionality of the radiation pattern of the horizontally polarized antenna that is within ±6 dB. For example, height H is 2.5–3.5 cm for a printed circuit board of 77×176 mm.

Figure 5B:
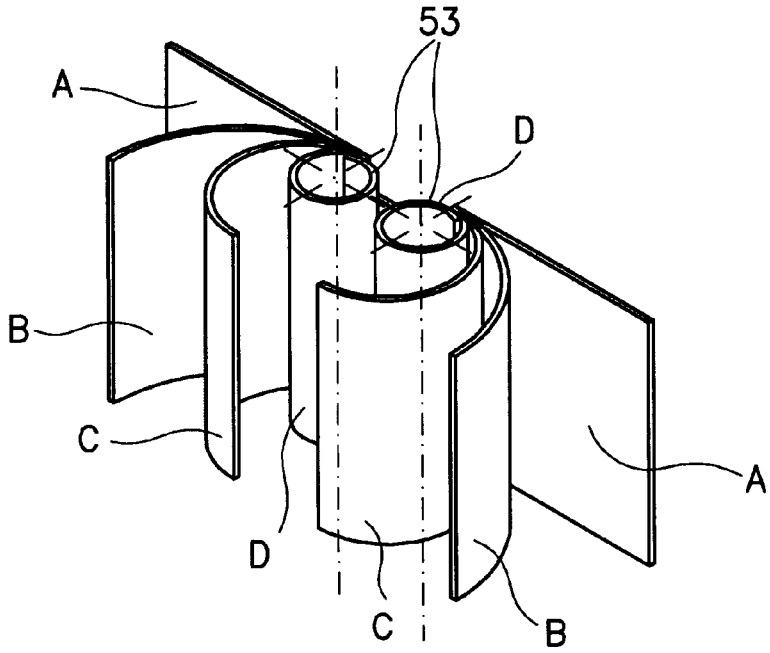

Reference is now made to FIGS. 5A, 5B, 5C and 5D, which illustrate the construction of double tube 52. Double tube 52 is formed from a generally rectangular piece of metal 70 (FIG. 5A) having two rectangular cutouts 72 along its longer sides. This forms two sections 74 whose outer edges 76 are rolled toward cutouts 72, as shown in FIG. 5B, to form the tubes 53. FIG. 5B shows the rolling in four stages, marked as A, B, C and D.

Figure 5C:
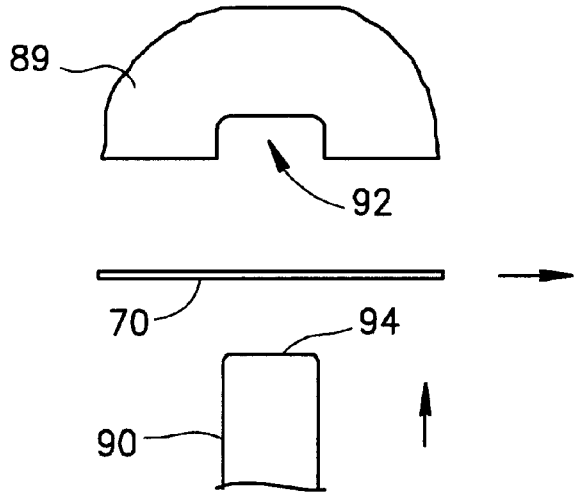
FIGS. 5C and 5D are schematic illustrations of a machine for rolling the sheet of FIG. 5A.
Figure 5D:
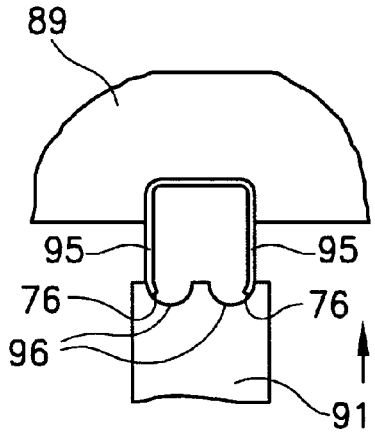

FIGS. 5C and 5D illustrate an apparatus for rolling tubes 53. The apparatus includes base 89, having a stepped indentation 92, and two dies 90 and 91. Die 90 has a flat end 94 and die 91 has two rounded indentations 96.

Sheet metal 70 is placed on base 89 after which die 90 presses sheet is metal 70 against base 89 and into indentation 92. This is shown in FIG. 5C. Die 90 is removed, leaving sheet metal 70 bent into a U shape having sides 95, as indicated in FIG. 5D. Die 91 is then pressed against ends 76 of metal 70. As die 91 moves closer to base 89, ends 76 follow the curve of rounded indentations 96, causing sides 95 to be rolled. Die 91 rolls sides 95 such that they overlap themselves a bit. For example, it can be rolled 380 degrees to provide a 20 degree overlap, where there are two layers of the metal. The overlapping sections touch each other or are very close to doing so. Because of the elasticity of the metal, the rolled sheet acts as a spring.

It will be appreciated that double tube 52 provides two tubes 53 connected to each other. By rolling the two edges 76 toward each other, two tubes 53 are created that are electrically sound (i.e. there is good electrical contact throughout the tube).

It will be appreciated that the height of cutouts 72 is greater than the largest possible height of teeth 44 and 58, such that double tube 52 can fit over teeth 44 and 58.

It is noted that the double tube 52 is thin and flexible and is formed by rolling a sheet of metal. The insulating tube 50 is of substantial thickness (e.g., there is 2–3 mm difference between outer and inner diameters). The inner diameter of insulating tube 50 is (typically a bit) larger than the diameter of the conducting wire, so the wire can be inserted into it. The ratio of the outer diameter of insulating tube 50 and the diameter of the conducting wire determines the characteristic impedance of the coaxial transmission line formed by this structure.

The outer diameter of insulating tube 50 is a bit larger than the inner diameter of outer conducting metal tube 53. Consequently, when insulating tube 50 is inserted into metal tube 53 (begun with the help of a tapered element or by initially placing insulating tube 50 at an angle to outer conducting metal tube 53 and then moving insulating tube 50 into outer conducting metal tube 53), metal tube 53 expands radially, thus forcing the inner layer of the overlapping section against the outer one. The result is a generally solid mechanical and electrical contact between the two layers, thereby creating a true conducting tube without the need to solder or weld. In addition, metal tube 53 now can hold insulating tube 50 in position.

Figure 6:
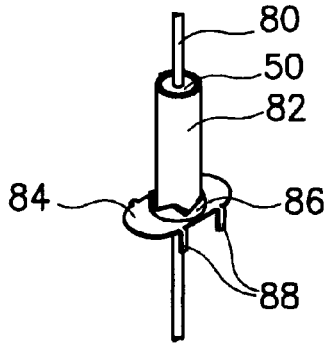
FIG. 6 is a schematic illustration of an alternative connector of the present invention for a single antenna.

It will be appreciated that the present invention can be made with two, separate metal tubes rather than double tube 52. It will also be appreciated, as shown in FIG. 6, that the present invention includes a single tube coaxial connector, for connecting a single antenna to a printed circuit board, manufactured in the method described hereinabove. The single tube connector comprises insulating tube 50 which receives a metal wire 80, an outer metal tube 82, an eyelet connector 84 having teeth 86 and pins 88. Outer metal tube 82 is formed of a rectangular piece of sheet metal rolled to have an overlap. It will further be appreciated that the connector, singly or doubly, provides coaxial connection to a printed circuit board. This connection can be for an antenna or for any other connection that requires a coaxial connection. For example, the connector can be used to connect a "double board" of two PC boards with some space between them, e.g. to allow for components, between which there is an RF signal. This is especially so if rigidity is desired, but also if a low cost connector is necessary.

Figure 7:
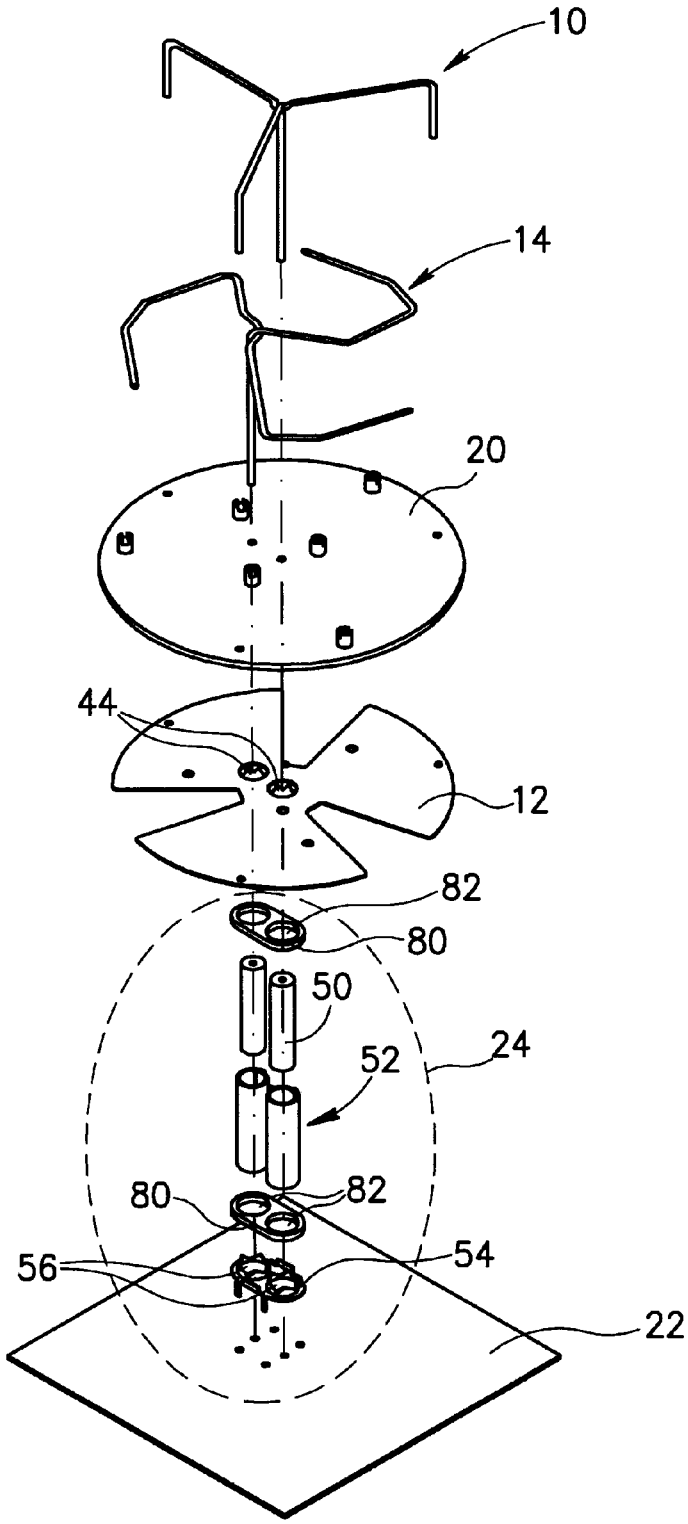
FIG. 7 is a schematic, exploded view of an antenna and coaxial connector, constructed and operative in accordance with an alternative preferred embodiment of the present invention.

Reference is now briefly made to FIG. 7, which illustrates an alternative embodiment of the antenna and connector of FIG. 1 in which double washers 80 are used in connector 24. Washers 80 each have two holes 82, where each hole 82 wraps around one set of teeth 44 and 56, thereby to push teeth 44 and 56 against double metal tube 52.

The methods and apparatus disclosed herein have been described without reference to specific hardware or software. Rather, the methods and apparatus have been described in a manner sufficient to enable persons of ordinary skill in the art to readily adapt commercially available hardware and software as may be needed to reduce any of the embodiments of the present invention to practice without undue experimentation and using conventional techniques.

It will be appreciated by persons skilled in the art that the present invention is not limited by what has been particularly shown and described herein above. Rather the scope of the invention is defined by the claims that follow.

What is claimed is:

1. A diversity polarization antenna for connecting to a printed circuit board, the antenna comprising:

a horizontally polarized antenna having a phase center;

a vertically polarized antenna having a phase center generally coincident with said phase center of said horizontally polarized antenna; and a fixed height coaxial connector for connecting said antennas to said printed circuit board, wherein said connector comprises:

two metal tubes generally having said fixed height;

two insulating tubes generally having said fixed height, each locatable in one of said two metal tubes, said insulating tubes having a diameter which is slightly wider than the outer diameter of a metal wire; and an eyelet connector having two short toothed tubes for receiving said metal tubes, said toothed tubes having a diameter which is generally the same as the outer diameter of said metal tubes, and having at least two pins for connecting into said printed circuit board.

2. The antenna according to claim 1 and wherein said two metal tubes are formed into a double tube unit.

3. A diversity polarization antenna for connecting to a printed circuit board, the antenna comprising:

a radiating wire for a vertically polarized antenna having a phase center;

a feeding wire for a horizontally polarized antenna, said horizontally polarized antenna having a phase center generally coincident with said phase center of said vertically polarized antenna;

a metal disk having notches, said metal disk forming part of said vertically polarized antenna and said notches forming part of said horizontally polarized antenna; and a fixed height coaxial connector for physically and electrically connecting said wires and said metal disk to said printed circuit board, wherein said metal disk has two short toothed tubes, the center of one of which coincides with the center of said metal disk.

4. The antenna according to claim 3 and wherein said connector comprises:

two metal tubes generally having said fixed height and locatable with said short toothed tubes of said metal disk;

two insulating tubes generally having said fixed height for receiving and insulating said feeding and radiating wires, each insulating tube being locatable in one of said two metal tubes; and an eyelet connector having said two short toothed tubes for receiving said metal tubes, said short toothed tubes having a diameter which is generally the same as the outer diameter of said metal tubes, and having at least two pins for connecting into said printed circuit board.

5. A coaxial connector for connecting two antennas to a printed circuit board, the connector comprising:

two metal tubes generally having a fixed height;

two insulating tubes generally having said fixed height, each locatable in one of said two metal tubes, said insulating tubes having an inner diameter which is slightly larger than the diameter of a metal wire; and an eyelet connector having two short toothed tubes for receiving said metal tubes, said short toothed tubes having a diameter which is generally the same as the outer diameter of said metal tubes and having at least two pins for connecting into said printed circuit board.

6. A coaxial connector for connecting to a printed circuit board, the connector comprising:

a metal tube generally having a fixed height;

an insulating tube generally having said fixed height for insulating a metal wire from said metal tube, locatable in said metal tube, said insulating tube having an inner diameter which is slightly larger than the diameter of said metal wire; and an eyelet connector having a short toothed tube for receiving said metal tube, said toothed tube having a diameter which is generally the same as the outer diameter of said metal tube and having at least two pins for connecting into said printed circuit board.

7. A coaxial connector for connecting a printed circuit board, the connector comprising:

a metal tube having an inner diameter formed of a metal sheet having ends, said metal tube formed by rolling said metal sheet such that said ends overlap;

an insulating tube, insertable in said metal tube and capable of pressing said overlapped ends against each other thereby to provide contact between them, said insulating tube for insulating a metal wire from said metal tube; and an eyelet connector having a short toothed tube for receiving said metal tube, said short toothed tube having a diameter which is generally the same as an outer diameter of said metal tube and having at least two pins for connecting into said printed circuit board.

8. A coaxial connector for connecting to a printed circuit board, the connector comprising:

a metal wire, a metal tube generally having a fixed height;

an insulating tube generally having said fixed height, locatable in said metal tube, said insulating tube having an inner diameter which is slightly larger than the diameter of said metal wire; and an eyelet connector having a short toothed tube for receiving said metal tube, said short toothed tube having a diameter which is generally the same as the outer diameter of said metal tube and having at least two pins for connecting into said printed circuit board.

9. A coaxial connector for connecting to a printed circuit board, the connector comprising:

two metal wires;

two metal tubes generally having a fixed height;

two insulating tubes generally having said fixed height, each locatable in one of said two metal tubes, said insulating tubes having an inner diameter which is slightly larger than the diameter of said metal wires; and an eyelet connector having two short toothed tubes for receiving said metal tubes, said toothed tubes having a diameter which is generally the same as the outer diameter of said metal tubes and having at least two pins for connecting into said printed circuit board.

10. A coaxial connector for connecting to a printed circuit board, the connector comprising:

a metal tube having an inner diameter and formed of a metal sheet having ends, said metal tube formed by rolling said metal sheet such that said ends overlap;

an insulating tube, insertable in said metal tube and capable of pressing said overlapped ends against each other thereby to provide contact between them;

a metal wire insertable into said insulating tube; and an eyelet connector having a short toothed tube for receiving said metal tube, said short toothed tube having a diameter which is generally the same as an outer diameter of said metal tube and having at least two pins for connecting into said printed circuit board.

11. An eyelet connector for connecting a metal unit to a printed circuit board, the eyelet connector comprising:

at least one short toothed tube for receiving at least one metal tube, said short toothed tubes having a diameter which is generally the same as the outer diameter of said at least one metal tube; and at least two pins for connecting to said printed circuit board.

* * * * *